US005394846A

United States Patent [19]

Jaeger et al.

[11] Patent Number: 5,394,846

[45] Date of Patent: Mar. 7, 1995

[54] THROTTLE BODY ASSEMBLY

[75] Inventors: Matthew W. Jaeger, Fond du Lac, Wis.; John E. Lingenfeleter, Decatur, Ind.; Steven M. Lippincott, Stillwater, Okla.; Jerry M. Stoll, Jr., Stillwater, Okla.; Brian R. White, Stillwater, Okla.

[73] Assignee: Brunswick Corporation, Lake Forest, Ill.

[21] Appl. No.: 104,380

[22] Filed: Aug. 9, 1993

[51] Int. Cl.[6] ..... F02M 23/02

[52] U.S. Cl. ..... 123/336; 123/339

[58] Field of Search ..... 123/336, 337, 339; 251/305

[56] References Cited

U.S. PATENT DOCUMENTS

| | | | |
|---|---|---|---|
| 3,741,178 | 6/1973 | Cedar | 123/336 |
| 3,830,206 | 8/1974 | Asaka et al. | 123/274 |
| 3,982,507 | 9/1976 | Asaka et al. | 123/336 |
| 4,232,640 | 11/1980 | Matsumoto et al. | 123/336 |
| 4,347,816 | 9/1982 | Saito et al. | 123/432 |
| 4,378,761 | 4/1983 | Kawamura | 123/336 |
| 4,384,559 | 5/1983 | Tchang et al. | 123/336 |
| 4,445,474 | 5/1984 | Nakao et al. | 123/336 |
| 4,491,106 | 1/1985 | Morris | 123/336 |
| 4,517,941 | 5/1985 | Nakagawa | 123/336 |
| 4,796,579 | 1/1989 | Wolfe et al. | 123/336 |
| 4,972,815 | 11/1990 | Yamamoto et al. | 123/337 |
| 5,101,784 | 4/1992 | Tamaki | 123/337 |

FOREIGN PATENT DOCUMENTS

| | | | |
|---|---|---|---|
| 3939198 | 5/1990 | Germany | 123/336 |
| 55-96346 | 7/1980 | Japan | 123/336 |
| 57-186048 | 11/1982 | Japan | 123/336 |
| 58-204944 | 11/1983 | Japan | 123/336 |

*Primary Examiner*—David A. Okonsky

*Attorney, Agent, or Firm*—Andrus, Sceales, Starke & Sawall

[57] ABSTRACT

A dual bore throttle body assembly for a marine engine. The assembly includes a body having a pair of side-by-side bores, each of which is adapted to be enclosed by a flat throttle valve. A separate shaft is connected to each throttle valve and a throttle cable is connected to the shafts through a progressive linkage. The linkage is constructed such that only one of the valves is initially opened, and when that valve is approximately 50 percent open, the second valve is then opened. The speed of opening of the second valve is greater than that of the first valve so that both valves will reach the full opened position at the same instant. Each shaft is provided with a longitudinal slot which receives the respective throttle valve, and the valves are secured within the slots by mechanical fasteners such as screws.

21 Claims, 2 Drawing Sheets

FIG. 5
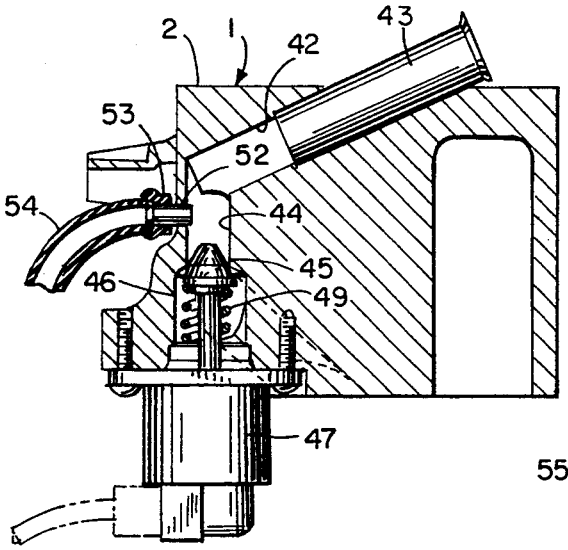
FIG. 6
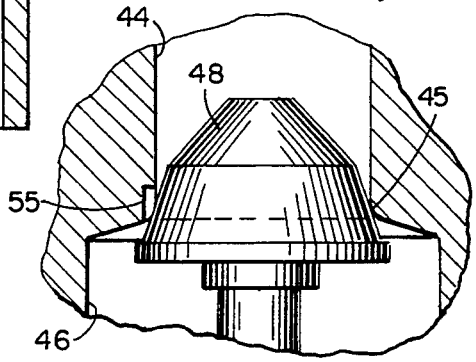
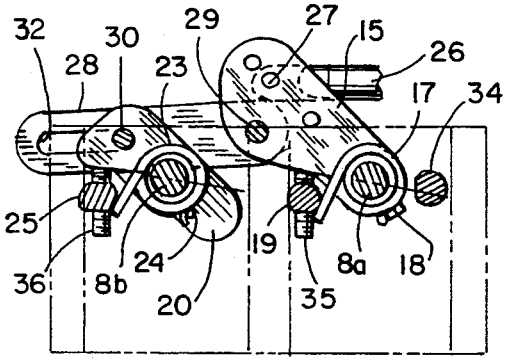
FIG. 7
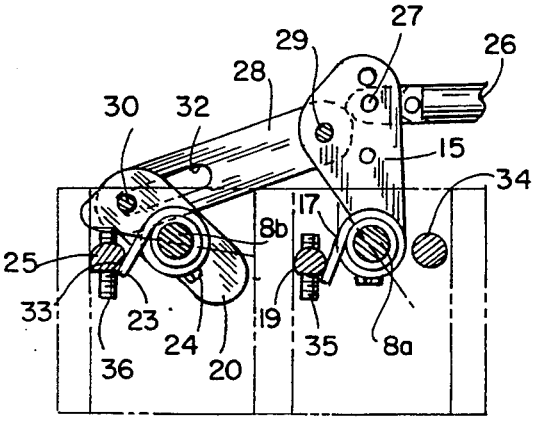
FIG. 8
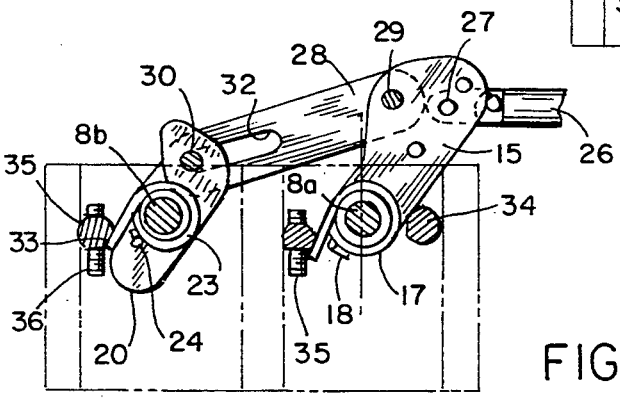
FIG. 9

THROTTLE BODY ASSEMBLY

BACKGROUND OF THE INVENTION

Internal combustion engines using a port fuel injection system include a throttle body assembly having a bore or passage enclosed by a butterfly-type throttle valve through which air is supplied to the plenum of the engine. With a large displacement engine, opposite faces of the throttle valve can be subjected to a substantial pressure differential when the valve is closed and the pistons are still drawing, thus causing possible deformation of the valve. Because of this, it has been the practice in larger displacement engines to utilize a pair of bores, each enclosed by a separate throttle valve, rather than employing a single, large bore with a single throttle valve.

The typical dual bore throttle valve assembly as used in the past has included a single horizontal shaft which is connected to both throttle valves. A throttle operating cable is connected to the shaft through a suitable linkage, and with this construction both valves are operated in unison. To attach the valves to the shaft, it has been common practice to mill the portions of the shaft extending across the bores to provide flat surfaces to which the valves are attached by mechanical fasteners, such as screws. Milling of the shaft tends to reduce the strength of the shaft and can cause deformation of the shaft under conditions where the valves are closed and are subjected to a substantial pressure differential.

It is also known to incorporate a progressive linkage in a dual bore throttle valve assembly for marine outboard motors. With a progressive linkage one of the valves will be opened before the other valve so that at low throttle speeds better control is obtained for docking and maneuvering of the boat.

SUMMARY OF THE INVENTION

The invention is directed to an improved dual bore throttle body assembly for a marine engine. The assembly includes a cast body having a pair of side-by-side parallel bores, each of which is enclosed by a generally flat throttle valve.

As a feature of the invention, each throttle valve is connected to a separate shaft and each shaft is provided with a longitudinal slot which receives the respective valve. The valves are secured to the shafts through mechanical fasteners, such as screws.

An end of one of the shafts connected to the primary throttle valve carries a link, and the throttle cable is attached to the link. The link associated with the primary valve is connected to the shaft of the secondary valve through a progressive linkage. The linkage is constructed such that the secondary valve will not open until the primary valve is approximately 50 percent open. The speed of movement of the secondary valve is greater, approximately twice, than the speed of movement of the primary valve so that both valves will reach the full open position at the same instant.

More specifically, the progressive linkage includes a link that is secured to the shaft of the secondary valve and an intermediate link connects the link on the primary valve with the link on the secondary valve. The connection of the intermediate link to the link associated with the secondary valve includes a lost motion connection which enables the primary valve to open to a predetermined position before the secondary valve begins to open.

The invention also incorporates a novel idle air control mechanism for supplying air to the plenum when the throttle valves are in the closed position. The idle air control mechanism includes a passage which extends from the atmospheric side of the throttle body and communicates with one of the bores downstream of the throttle valve. An idle air control valve, such as a needle valve, controls the flow of air through the passage and the needle valve is operated by a stepper motor that is controlled by the engine control module. When the throttle valves are closed, the engine control module will operate the air control motor to operate the needle valve and control the flow of air through the passage to the engine.

A second passage intersects the idle air control passage in the body, and the second passage is connected via a transparent sight tube to a mechanical diaphragm fuel pump. If the diaphragm should rupture, fuel will be visible within the sight tube, and any fuel in the sight tube will be drained into the idle air control passage and to the engine, rather than being drained overboard or to the bilge of the boat. The idle air control valve seat is provided with a notch so that even if the valve is in the closed position, any fuel entering the idle air control passage can drain through the notch into the bore of the body and then to the engine.

Other objects and advantages will appear during the course of the following description.

DESCRIPTION OF THE DRAWINGS

The drawings illustrate the best mode presently contemplated of carrying out the invention.

In the drawings:

FIG. 5 is a section taken along line 5—5 of FIG. 1; and showing the idle air control mechanism;

FIG. 6 is an enlarged fragmentary section showing the idle air control valve;

FIG. 7 is a section taken along line 7—7 of FIG. 1 and showing the position of the progressive linkage when the throttle valves are in the closed position;

FIG. 8 is a view similar to FIG. 7 showing the position of the linkage when the primary throttle valve is approximately 50% open; and FIG. 9 is a view similar to FIG. 7 showing the position of the linkage when the primary and secondary valves are in the full open position.

DESCRIPTION OF THE ILLUSTRATED EMBODIMENT

Figure 1:
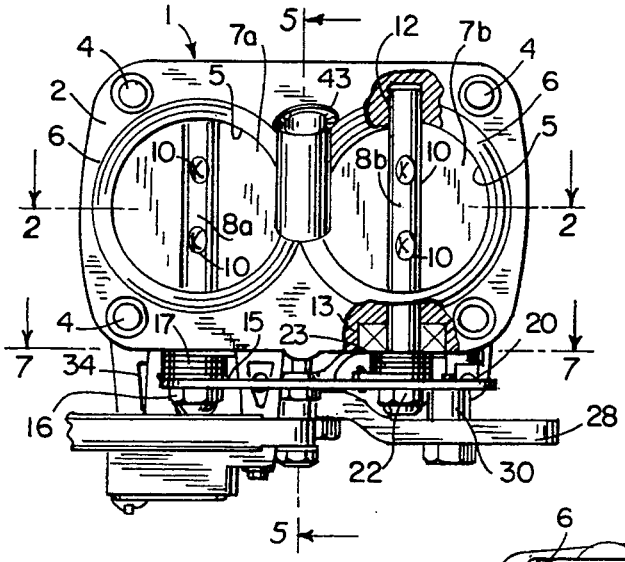
FIG. 1 is a front elevation of the throttle body assembly of the invention.
Figure 2:
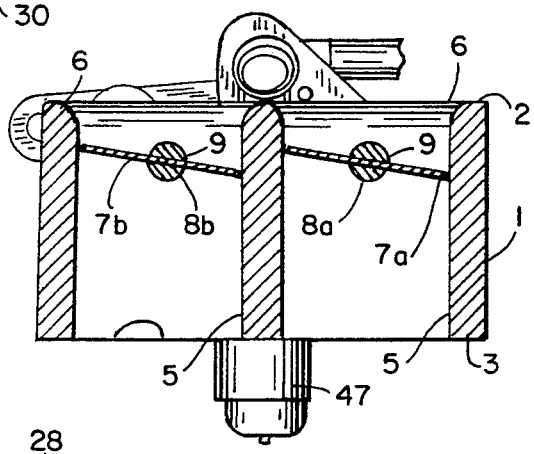
FIG. 2 is a section taken along line 2—2 of FIG. 1.

The drawings illustrate an improved dual bore throttle body assembly for a marine engine. The assembly includes a body 1, preferably cast from a metal such as aluminum and having a chromate coating for corrosion resistance. Body 1 includes an outer face 2 which faces outwardly and is exposed to the atmosphere, and an inner face 3 which is adapted to be secured to the plenum of the engine. Body 1 includes a series of holes 4 which are adapted to receive bolts to connect the body to the plenum.

Body 1 is formed with a pair of side-by-side parallel bores 5 and the end of each bore facing outwardly is provided with a radiused edge 6.

Bores 5 are adapted to be closed by generally flat butterfly-type throttle valves *7a* and *7b*. Valves *7a* and *7b* are preferably formed of a corrosion-resistant metal such as brass.

Each valve 7 is mounted on a vertical shaft *8a* and *8b*. To secure valve 7 to the respective shafts, the portion of each shaft extending across the bore 5 is provided with a longitudinal slot 9 which receives the respective valve, and the valves are secured within the slots by mechanical fasteners such as screws 10. In addition, a suitable thread locking material should be used in conjunction with the screws 10 to insure that the screws will not loosen during engine operation and will be retained in position.

To mount the shafts 8 for rotation, the upper end of each shaft is received within a bore 12 in body 1, as shown in FIG. 1, while the lower end of each shaft, which is subjected to the greatest stress during operation, is journaled within a ball bearing assembly 13 secured by a bonding agent in cavity 14 of body 1.

In practice, the throttle shafts *8a* and *8b* are offset a slight distance, approximately 0.020 inch, from the bore centerline, so that engine vacuum produces a moment arm which tends to close the throttle valves.

The lower end of shaft *7a* is secured to one end of a link 15 by lock nut 16 and the throttle valve *7a* is biased to a closed position by a torsion spring 17. Torsion spring 17 is preferably formed of stainless steel wire having a generally square cross section. One end of the torsion spring is engaged with a downwardly extending ear on link 15 while the other end of the torsion spring engages a post 19 on body 1. With this construction the force of the spring will urge the valve *7a* to the closed position.

Throttle valve *7b* is connected to the central portion of a link 20 by lock nut 22 and valve *7b* is biased to the closed position by a torsion spring 23 which is similar in construction to torsion spring 17. One end of spring 17 is engaged with an ear 24 on link 20, while the opposite end of the spring is engaged with a post 25 on body 1. Thus the force of spring 23 will tend to rotate the shaft 8 in a direction to urge valve *7b* to the closed position.

A conventional throttle operating cable 26 is connected to a pin 27 which extends outwardly from the end of link 15.

Figure 3:
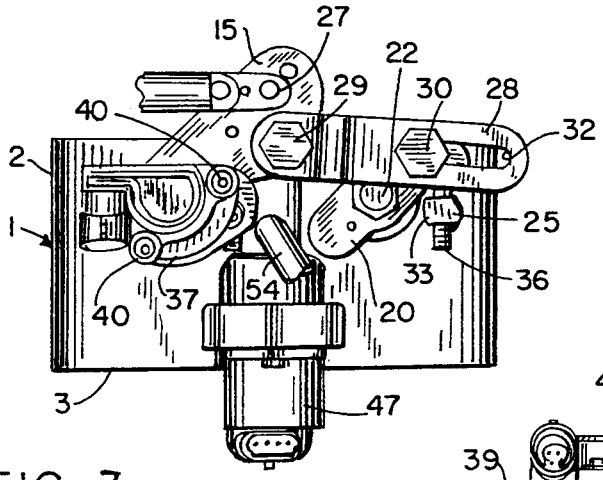
FIG. 3 is a bottom view of the assembly.

Connecting links 15 and 20 is an intermediate link 28. One end of link 28 is pivotally connected to link 15 about pivot 29 while the opposite portion of link 28 is pivotally connected to link 20 through pivot pin 30. Pivot pin 30 extends through a longitudinal slot 32 formed in link 28 as best shown in FIG. 3. Slot 32 serves as a lost motion connection.

Links 15, 20 and 28 provide a progressive linkage in which the primary valve *7a* will open before the secondary valve *7b*. The linkage is designed so that the primary throttle valve *7a* will be approximately 52% open before the secondary valve *7b* will begin to open. As shown in FIG. 7, the distance between the axis of shaft *8a* and the pivotal connection to the cable at 27 is approximately twice the distance between the axis of shaft *8b* and the pivot pin 30. This differential in distance enables the link 20 to move toward the open position at a speed approximately twice that of the speed of movement of link 15. Therefore, even though valve *7b* does not begin to open until the primary valve *7a* is approximately 52% open, both valves will reach the full open position at approximately the same instant.

This progressive linkage provides greater control at low speeds, particularly when docking or maneuvering the boat.

As seen in FIG. 3, post 25 is provided with a flat 33 which is adapted to be engaged by the edge of link 20 when the throttle valve *7b* is in the full open position. The stop formed by flat 33 prevents the link 20 from moving to an over center position, and in the event the torsion spring 23 should break, the throttle valve *7b* can be moved to its closed position through operation of the throttle cable 26.

A machined flat 34 is also provided on body 1 and serves as a stop for the full open position of link 15. In addition, stop screws 35 and 36 are threaded within openings in posts 19 and 25 and the upper ends of the stop screws 35 and 36 serve as stops to be engaged by the edges of the levers 15 and 28, thus providing stops for the closed position of the valves *7a* and *7b*.

Figure 4:
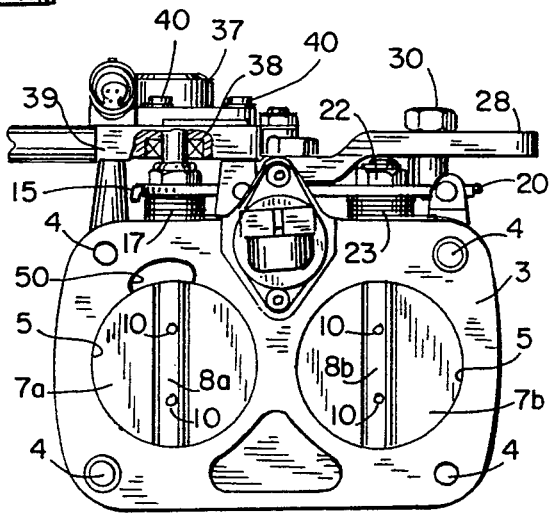
FIG. 4 is a rear view of the assembly with the assembly shown in an inverted position.

A conventional throttle position sensor (TPS) 37 is incorporated with the shaft *8a* and serves to provide a signal to the computer as to the position of the valve *7a*. As shown in FIG. 4, the lower end of shaft *8a* is sealed within a lip type seal 38 in adaptor 39 and the sensor 37 is secured to the outer surface of adaptor 39 by screws 40. Seal 38 prevents pooling of moisture in the TPS during normal operation. The sensor will sense the rotation of shaft *8a* and thus the position of the valve *7a*. By mounting the sensor 37 on the operating end of shaft *8a*, the upper surface of the body 1 is clean and free of obstructions.

If the sensor 37 was mounted directly to body 1, the position of screws 40 would interfere with the progressive linkage. Thus the adaptor 39 is employed, which is connected to the body at locations that will not interfere with the operation of the linkage and the sensor 37 is then attached to the adaptor through screws 40.

The invention also includes a novel idle air control mechanism which is best illustrated in FIGS. 5 and 6. A diagonal passage 42 is formed in the atmospheric face 2 of body 1 and the outer end of passage 42 receives an air inlet tube 43. The inner end of passage 42 communicates with a passage 44 that defines a valve seat 45. The portion of passage 44 located inwardly of valve seat 45 is enlarged, as indicated by 46.

Mounted within passage 46 is a stepper motor 47 and an idle air control valve, which can take the form of a needle valve 48, is operably connected to the motor and is adapted to engage valve seat 45. Operation of motor 47 will act to move needle valve 48 axially toward and away from the valve seat 45.

Motor 47 is controlled by the engine control module. When the throttle valve *7a* and *7b* are closed, the amount of air leakage around the valves is calibrated, and the engine control module operates the motor 47 to control air flow to the engine.

Passage 46 is connected by a passage 49 to one of the bores 5. The connection to bore 5 is downstream of the throttle valve *7a* and intersects the bore at the notched area 50 as shown in FIG. 4.

Marine engines normally employ a mechanical diaphragm pump in the fuel supply system. The conventional diaphragm pump is constructed in a manner such that the pump will continue to pump fuel if the diaphragm ruptures. Thus it is customary to incorporate a sight tube with the pump. Then, if the diaphragm is ruptured but is still pumping fuel, fuel will be visible in the sight tube, indicating a need to service the fuel pump. Any fuel in the sight tube cannot be drained overboard or to the bilge of the boat. Accordingly, the invention incorporates a mechanism for draining any fuel in the sight tube through the throttle body assembly to the engine. In this regard, body 1 is formed with a port 52 which communicates with passage 44 upstream of valve seat 45, as shown in FIG. 5. Nipple 53 is mounted in passage 52 and sight tube 54 is connected to the nipple. Thus any fuel in the sight tube 54 will drain into passage 44 through the open valve 48 and through passage 49 to the engine.

To insure that any fuel entering the body through the sight tube 54 will be drained during periods when valve 48 may be closed, valve seat 45 is provided with a notch 55, as shown in FIG. 6. Notch 55 provides a passage through which fuel can flow in the event the valve 48 is in the closed position against valve seat 45. Thus the invention provides a novel idle air control mechanism which incorporates a provision for draining any fuel which may accumulate within the sight tube 44 to the engine. Tube 43 ensures that any fuel entering passage 44 will drain into the engine and not out the bilge.

Various modes of carrying out the invention are contemplated as being within the scope of the following claims, particularly pointing out and distinctly claiming the subject matter which is regarded as the invention.

We claim:

1. A throttle body assembly, comprising a body having a pair of side-by-side bores, a throttle valve disposed in each bore and movable between a closed position and an open position, a separate shaft connected to each throttle valve, operating means operably connected to said shafts to rotate the shafts and move the valves between the closed and open positions, and linkage means interconnecting said operating means and said shafts, said linkage means being constructed and arranged to move a first of said valves from the closed position toward the open position before the second of said valves is moved from the closed position to the open position, said linkage means including a first link connected to said first shaft at a first connection, said operating means being pivotally connected to said first link at a second connection, a second link pivotally connected to the first link at a third connection, a third link connected to said second shaft at a fourth connection, said second link being connected to said third link at a fifth lost motion connection, said lost motion connection being constructed and arranged such that pivotal movement of said third link is delayed after initial pivotal movement of said first link.

2. The assembly of claim 1, wherein said fifth lost motion connection includes an elongated slot in said second link and a pin secured to said third link and slidable in said slot.

3. The assembly of claim 1, wherein the distance between said first and second connections is greater than the distance between said fourth and fifth connections.

4. The assembly of claim 2, wherein the distance between said first and second connections is approximately twice the distance between said fourth and fifth connections.

5. The assembly of claim 1, wherein said operating means comprises a throttle cable.

6. The assembly of claim 1, and including biasing means for biasing each valve to the closed position.

7. The assembly of claim 6, wherein said biasing means includes a pair of torsion springs, a first of said torsion springs interconnecting said body and said first link, and a second of said torsion springs interconnecting said body and said third link.

8. The assembly of claim 6, and including stop means mounted on the body and disposed to be engaged by said third link when said valves are in the open position.

9. The assembly of claim 1, wherein the axis of each shaft is normal to and offset from the axis of the respective bore whereby engine vacuum will produce a moment arm which acts in a direction to close the respective throttle valves.

10. The assembly of claim 1, wherein each shaft includes an elongated slot to receive the respective valve, and fastening means for connecting each valve within the respective slot.

11. The assembly of claim 10, and including journaling means connected to the body for journaling the shafts for rotation.

12. The assembly of claim 11, wherein said journaling means comprises a ball bearing assembly connected to the body for journaling each shaft.

13. A dual bore throttle body assembly, comprising a body having a first atmospheric side exposed to the atmosphere and a second side exposed to an engine, said body having a pair of side-by-side bores extending between said atmospheric side and said second side, a throttle valve disposed in each bore and being movable between a closed position and an open position, a separate shaft connected to each throttle valve, operating means operably connected to said shafts to rotate said shafts and thereby move said valves between the closed and open positions, passage means extending from the atmospheric side to the engine side of said body, said body including a port communicating with said passage means, conduit means connecting the port with a fuel pump, and idle air control means including a valve member for controlling flow of air through said passage means to the engine when said throttle valves are in the closed position.

14. The assembly of claim 13, wherein said passage means communicates with one of said bores downstream of the respective throttle valve.

15. The assembly of claim 14, wherein said passage means is connected to said one bore adjacent the engine side of the body.

16. The assembly of claim 13, wherein said conduit means comprises a transparent sight tube.

17. The assembly of claim 13, wherein the connection of said port to said passage means is located upstream of said valve member.

18. The assembly of claim 13, wherein said body is provided with a valve seat bordering said passage means, said valve member disposed to engage said seat, said assembly also including means for effecting leakage of fuel past said valve member when said valve member is in the closed position.

19. The assembly of claim 18, wherein said means for effecting leakage of fuel comprises a notch formed in said valve seat.

20. A throttle body assembly, comprising a body having a first atmospheric side exposed to the atmosphere and a second side exposed to an engine, said body having a bore extending between said atmospheric side and said second side, a throttle valve disposed in said bore and movable between a closed position and an open position, a shaft connected to said throttle valve, operating means operably connected to said shaft to rotate said shaft and thereby move said valve between a closed and an open position, passage means in said body, a first end of said passage means communicating with said atmospheric side and a second end of said passage means communicating with said second side, said body having a valve seat bordering said passage means, idle air control means including a valve member disposed to engage said valve seat for controlling flow of air through said passage means to the engine when the throttle valve is in the closed position, said body including a port communicating with said passage means at a location between the first end of said passage means and said valve seat, and conduit means connecting the port with a fuel pump.

21. The assembly of claim 20, and including a notch in said valve sent to permit leakage of fuel past said valve member from said conduit means to the second end of said passage means when said valve member is in the closed position.

* * * * *